US007430818B2

(12) United States Patent
Valat et al.

(10) Patent No.: US 7,430,818 B2
(45) Date of Patent: Oct. 7, 2008

(54) ITEM OF FOOTWEAR HAVING A RIGID SHELL AND FLEXIBLE PAD

(75) Inventors: Gérard Valat, Aix-En-Provence (FR); Cédric Ragot, Paris (FR)

(73) Assignee: Random Design, Aix-En-Provence (FR)

( * ) Notice: Subject to any disclaimer, the term of this patent is extended or adjusted under 35 U.S.C. 154(b) by 349 days.

(21) Appl. No.: 10/518,519

(22) PCT Filed: Jun. 17, 2003

(86) PCT No.: PCT/FR03/01837

§ 371 (c)(1),
(2), (4) Date: Dec. 29, 2005

(87) PCT Pub. No.: WO04/000056

PCT Pub. Date: Dec. 31, 2003

(65) Prior Publication Data

US 2006/0101672 A1 May 18, 2006

(30) Foreign Application Priority Data

Jun. 20, 2002 (FR) ..... 02 07634

(51) Int. Cl.
*A43B 5/00* (2006.01)
*A43B 23/00* (2006.01)

(52) U.S. Cl. ..... 36/45; 36/117.1; 36/131; 36/87

(58) Field of Classification Search ..... 36/131, 36/71, 45, 25 R, 28, 31, 109, 117.1, 102, 36/117.3, 87, 117.2, 118.2, 103
See application file for complete search history.

(56) References Cited

U.S. PATENT DOCUMENTS

| | | | | |
|---|---|---|---|---|
| 2,292,556 | A * | 8/1942 | Whitman | 36/71 |
| 3,363,342 | A * | 1/1968 | Stohr | 36/117.3 |
| 3,419,974 | A * | 1/1969 | Lange | 36/117.6 |
| 4,062,133 | A * | 12/1977 | McGee et al. | 36/131 |
| 4,505,056 | A | 3/1985 | Beneteau | |
| 4,640,027 | A * | 2/1987 | Berlese | 36/131 |
| 4,882,858 | A * | 11/1989 | Signori | 36/131 |
| 5,086,575 | A * | 2/1992 | Bonaventure | 36/117.3 |
| 5,325,611 | A * | 7/1994 | Dyer et al. | 36/30 R |
| 5,681,649 | A * | 10/1997 | Mashita et al. | 428/212 |
| 6,112,435 | A | 9/2000 | Collavo | |
| 6,671,981 | B2 * | 1/2004 | Brooks | 36/95 |
| 6,826,853 | B1 * | 12/2004 | Zanatta | 36/131 |
| 7,000,334 | B2 * | 2/2006 | Gillespie | 36/28 |

(Continued)

FOREIGN PATENT DOCUMENTS

EP 0 931 468 7/1999

*Primary Examiner*—Marie Patterson
(74) *Attorney, Agent, or Firm*—Young & Thompson

(57) ABSTRACT

An item of footwear, particularly a motorcycle boot (1), includes a rigid shell (4) which defines a body that is designed to surround the foot of the user. The body consists of a lower sole-forming part (20), an upper vamp-forming part (22), an inner lateral part and an outer lateral part, the lateral parts connecting the aforementioned lower and upper parts. The inventive item of footwear includes an opening (16, 18) in one of the four constituent body parts, which passes through the rigid shell and which is sealed by a flexible half-sole (12, 14).

20 Claims, 1 Drawing Sheet

U.S. PATENT DOCUMENTS

| | | | | |
|---|---|---|---|---|
| 7,124,519 | B2 * | 10/2006 | Issler | 36/31 |
| 7,257,908 | B2 * | 8/2007 | Valat et al. | 36/131 |
| 2002/0004997 | A1 | 1/2002 | Quagliotto et al. | |
| 2002/0112374 | A1 * | 8/2002 | Gillespie | 36/28 |
| 2005/0150134 | A1 * | 7/2005 | Issler | 36/102 |
| 2005/0246923 | A1 * | 11/2005 | Bergamin | 36/131 |
| 2006/0130364 | A1 * | 6/2006 | Greene et al. | 36/28 |

* cited by examiner

ITEM OF FOOTWEAR HAVING A RIGID SHELL AND FLEXIBLE PAD

BACKGROUND OF THE INVENTION

The invention relates to an item of footwear, in particular a motorcycle boot.

It is particularly suitable for motor sports and, more particularly, off-road motorcycle sports where the feet of the user are very exposed. However, it can also be found to be advantageous for road racing or mountain biking in particular.

Motocross boots which have a leather upper onto which plastics reinforcements are fixed are already known. The reinforcements provide protection, whilst the leather brings about the connection between the reinforcements and allows a degree of flexibility. Boots of this type are hardly satisfactory since the protection is limited.

SUMMARY OF THE INVENTION

The object of the invention is to provide protection for the feet of a user without depriving him of the sensations necessary for participation in his activity. To this end, according to the invention, the item of footwear comprises a rigid shell which is produced from a first material and which defines a body which is intended to surround the foot of a user, the body has a lower portion which forms a sole, an upper portion which forms a vamp, an inner lateral portion and an outer lateral portion, said lateral portions connecting the lower portion and the upper portion, and these four portions extend in an extension direction between a first zone which forms a heel and a second zone which forms a tip, said item has an opening defined in only one of the said four portions of the body, said opening extending through the rigid shell and being closed by means of a flexible pad which is produced from a second material, said second material being more flexible than the first.

In this manner, the rigid shell effectively protects the foot of the user against impacts. The localized opening through the shell allows the user to feel, via the flexible pad, the contact of the item of footwear with an external element, such as a gear lever or a motorcycle footbrake. The item of footwear advantageously comprises more than one opening which extends through the shell, but each of them is included in a single portion of the body so as not to compromise the rigidity of the shell and the protection of the user.

The term flexible must be understood in the sense of having lower Shore hardness.

Advantageously, according to the invention, the opening is provided with spacing from the ends of the body in the extension direction.

Since the end portions are most exposed to risk of impacts, it is preferable not to provide any opening in the shell at that location.

According to another advantageous feature of the invention, the opening is provided in a zone of the lower portion which serves to support the sole of the foot of the user.

Since that region of the sole of the foot is very sensitive, this solution is particularly suitable for sensing elements which are located below the foot.

Additionally, the invention proposes that the opening extends transversely to the extension direction over less than half the width of the item of footwear.

The opening which is provided through the shell thus hardly reduces the protection of the foot and does not inconvenience the user when walking.

Furthermore, according to the invention, the pad extends in a recessed manner relative to the rigid shell.

There is thus less risk of the pad becoming damaged when the user walks on the ground.

On the other hand, the invention proposes that an opening is provided in the upper portion so that the user can feel the contact with an element which is located above his foot.

BRIEF DESCRIPTION OF THE DRAWINGS

The invention will be appreciated even more clearly from the following description, given with reference to the appended drawings, in which.

DETAILED DESCRIPTION OF THE PREFERRED EMBODIMENTS

Figures 1, 2, 3:
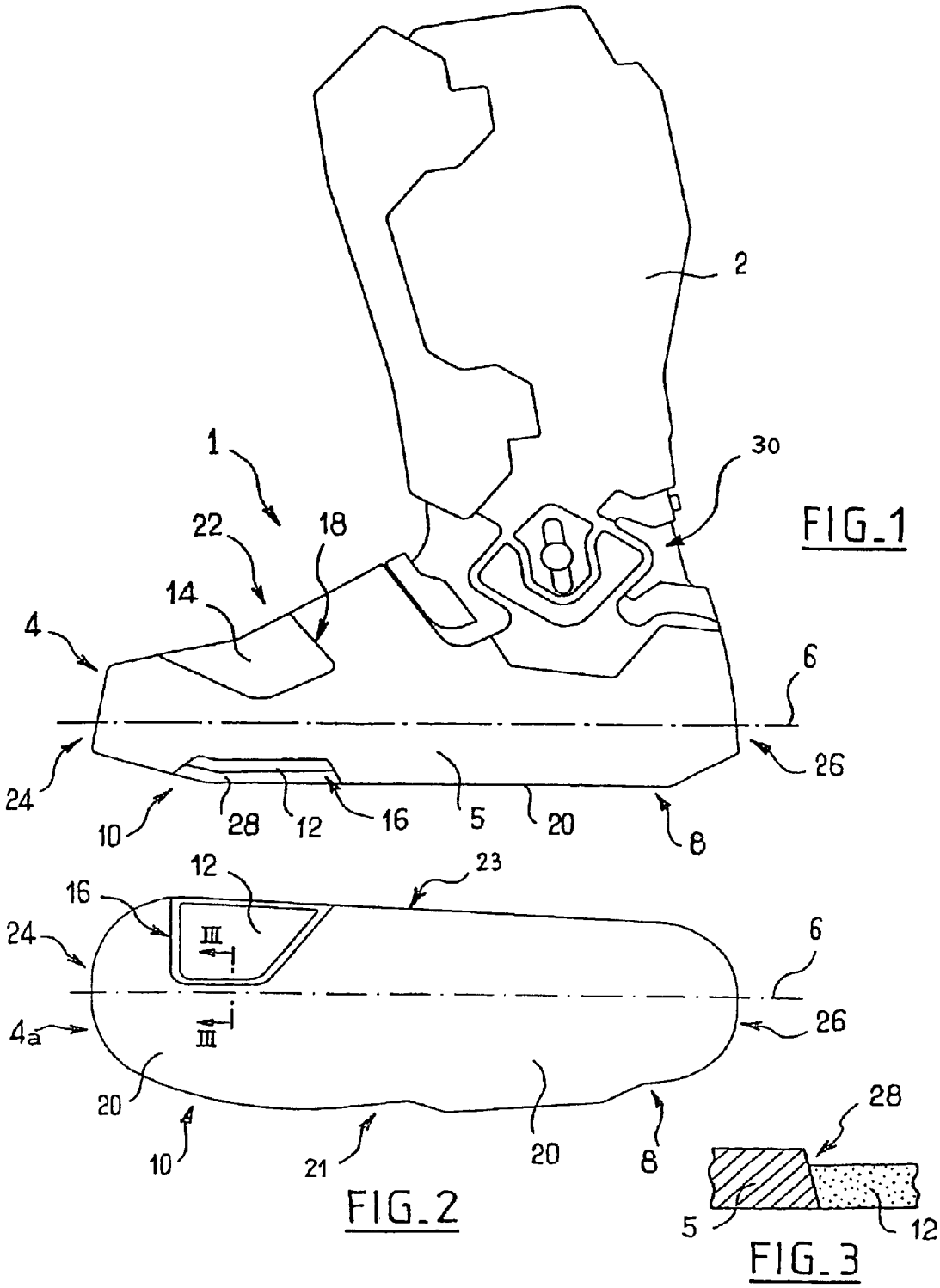
FIG. 1 is a side view of a boot according to the invention.
FIG. 2 is a view of the boot from below.
FIG. 3 is an enlarged view taken on line III-III of FIG. 2.

FIGS. 1 and 2 illustrate a motorcycle boot 1 which substantially comprises a body 4 which is intended to receive the foot of a motorcyclist and which is articulated relative to a portion 2 which forms an upper which is intended to receive the leg of the motorcyclist via articulation means 30.

The body 4 has an inner face and an outer face. It is substantially constituted by a rigid shell 5 which extends in an extension direction 6 between a rear zone 8 which forms a heel and a front zone 10 which forms a tip. It comprises a lower portion which forms a sole 20, an upper portion which forms a vamp 22, an inner lateral portion 21 and an outer lateral portion 23 which connect the lower portion 20 and the upper portion 22.

Openings 16, 18 are provided over the entire thickness of the shell 5 in order to allow the user to have tactile sensations. Each of said openings 16, 18 is included in only one of the four portions, the lower portion 20, upper portion 22, and lateral portions 21, 23, in order to allow the body to maintain its rigidity and to provide effective protection for the foot of the user. These openings 16, 18 are provided in the lower portion 20 which forms a sole and in the upper portion 22 which forms a vamp, respectively. They are closed by means of a lower flexible pad 12 and an upper flexible pad 14 which extend inside said openings and which are defined in the immediate proximity of said openings. Said openings 16, 18 are further produced substantially with spacing from the front end 24 and rear end 26 of the body 4 in the direction of extension 6.

The lower opening 16 is produced in the sole 20 in the zone of the tip 10 and, more precisely, in a zone which is intended to receive the sole of the foot of the user. It extends transversely to the extension direction 6 from the inner face **4*a*** over a width which is slightly less than half the width of the boot at this location.

The flexible pad 12 has a slight recess 28 relative to the general surface of the sole 20.

The upper opening 18 is produced in the zone of the tip 10 and, more precisely, in the vamp 22, substantially at the centre thereof in the longitudinal direction 6.

In order to retain the flexible pads 12, 14 more effectively inside the openings 16, 18, provision may be made for the flexible pads to further extend slightly outside the openings 16, 18 in the immediate vicinity of the said openings, which would further prevent premature wear at this location of the inner lining (not shown) which is intended to be introduced inside the body 4 in order to receive the foot of the user in a tight manner therein.

The pad is advantageously produced from leather or from foam based on an elastomer material. The hardness thereof is advantageously between 60 and 80 Shore, whilst the hardness of the rigid shell 4 is advantageously between 80 and 120 Shore. Furthermore, the Shore hardness rating of the rigid shell 4 is advantageously at least 20%, preferably at least 30%, greater than the Shore hardness rating of the pad 12.

The invention claimed is:

1. Item of footwear, comprising:

a rigid shell which is produced from a first material and which defines a body which is intended to surround the foot of a user, the body having a lower portion which forms a sole, an upper portion which forms a vamp, an inner lateral portion and an outer lateral portion, said lateral portions connecting the lower portion and the upper portion, these four portions extending in an extension direction between a first zone which forms a heel and a second zone which forms a tip; and an opening defined in only one of said four portions of the body, said opening extending through the rigid shell and being closed by means of a flexible pad which is produced from a second material, said second material being more flexible than the first material.

2. Item of footwear according to claim 1, wherein the opening is provided with spacing from the ends of the body in the extension direction.

3. Item of footwear according to claim 1, wherein the opening is provided in a zone of the lower portion which serves to support the sole of the foot of the user.

4. Item of footwear according to claim 3, wherein the opening extends transversely to the direction of extension over less than half the width of the item of footwear.

5. Item of footwear according to claim 3, wherein the pad extends in a recessed manner relative to the rigid shell.

6. Item of footwear according to claim 2, wherein the opening is provided in the upper portion.

7. Item of footwear according to claim 6, wherein the opening is provided substantially at the centre of the upper portion relative to the extension direction.

8. Item of footwear according to claim 1, wherein the first material has a hardness which is at least 20% greater than the hardness of the second material.

9. Item of footwear according to claim 8, wherein the pad has a hardness of between 60 and 80 Shore.

10. Item of footwear according to claim 1, further comprising another rigid shell which defines an upper which is intended for receiving the leg of the user and means for articulating the upper relative to the body.

11. Item of footwear according to claim 2, wherein the opening is provided in a zone of the lower portion which serves to support the sole of the foot of the user.

12. Item of footwear according to claim 4, wherein the pad extends in a recessed manner relative to the rigid shell.

13. Item of footwear according to claim 3, further comprising another opening provided in the upper portion.

14. Item of footwear according to claim 4, further comprising another opening provided in the upper portion.

15. Item of footwear according to claim 5, further comprising another opening provided in the upper portion.

16. Item of footwear according to claim 2, wherein the first material has a hardness which is at least 20% greater than the hardness of the second material.

17. Item of footwear according to claim 3, wherein the first material has a hardness which is at least 20% greater than the hardness of the second material.

18. Item of footwear according to claim 4, wherein the fist material has a hardness which is at least 20% greater than the hardness of the second material.

19. Item of footwear according to claim 5, wherein the first material has a hardness which is at least 20% greater than the hardness of the second material.

20. Item of footwear according to claim 6, wherein the first material has a hardness which is at least 20% greater than the hardness of the second material.

* * * * *